United States Patent [19]

Henderson

[11] Patent Number: 4,534,737

[45] Date of Patent: Aug. 13, 1985

[54] OUTBOARD MOTOR SYSTEM

[75] Inventor: Ronald C. Henderson, Cohassett, Mass.

[73] Assignee: Mathewson Corporation, Quincy, Mass.

[21] Appl. No.: 495,528

[22] Filed: May 17, 1983

[51] Int. Cl.[3] ..... B63H 5/12

[52] U.S. Cl. ..... 440/53; 114/150

[58] Field of Search ..... 440/53, 55, 56, 58–65; 114/150

[56] References Cited

U.S. PATENT DOCUMENTS

| | | | |
|---|---|---|---|
| 2,458,813 | 1/1949 | Wanzer | 440/59 |
| 3,122,123 | 2/1964 | Shallbetter et al. | 440/59 |
| 3,396,692 | 8/1968 | Bergstedt | 440/62 |
| 3,486,478 | 12/1969 | Halliday | 440/62 |
| 3,520,272 | 7/1970 | Ellzey | 440/88 |
| 3,885,517 | 5/1975 | Borst et al. | 440/56 |

*Primary Examiner*—Jesus D. Sotelo

*Attorney, Agent, or Firm*—Gammons, Robert T.

[57] ABSTRACT

An outboard propulsion system comprising a support for attachment to the deck of a vessel to which is bolted a prime mover with its drive shaft in a horizontal position transversely of the vessel, a propulsion assembly supported by the support in suspension outboard of the vessel for arcuate movement about a horizontal axis parallel to the axis of the drive shaft, the propulsion assembly comprising an upper gear box, an input shaft journaled in the gear box on an axis coinciding with said horizontal axis, a steering column connected at its upper end to the gear box for rotation about an axis at right angles to the axis of the input shaft, a lower gear box fixed to the lower end of the steering column within which is journaled a propeller shaft, gears in the lower gear box drivably connecting the propeller shaft to the transmission shaft, a hydraulic elevating cylinder for effecting arcuate movement of the propulsion assembly in a vertical plane about the axis of the input shaft, a hydraulic clutch for operably connecting the input shaft to the transmission shaft, a hydraulic motor for effecting rotation of the steering column, a hydraulic pump coupled to the input shaft for generating hydraulic pressure and circuitry for supplying the hydraulic pressure to the hydraulic elevating cylinder, the hydraulic clutch and the hydraulic motor.

14 Claims, 6 Drawing Figures

OUTBOARD MOTOR SYSTEM

BACKGROUND OF INVENTION

In my U.S. Pat. No. 4,389,198 of June 29, 1983, there is shown and described an outboard motor system comprising a support adapted to be bolted to the deck of a vessel for supporting a prime mover with its drive shaft in a horizontal position transversely of the vessel and for supporting an outboard propulsion assembly outboard of the vessel with its input shaft parallel to the output shaft of the prime mover for pivotal movement in a vertical plane at right angles about an axis coinciding with the axis of the input shaft. The system shown therein embodies the advantages that; no struts or other supporting structure below deck are required to hold the propulsion assembly in its operative position, hence, it may be easily installed for use or removed without having to break weldments or detach bolts below deck; it is free to pivot about its pivot axis in the event that, if it strikes an underwater obstruction, it avoids damage to the propeller or its supporting structure; it can be elevated to an out-of-water position above deck for repair when necessary; the input shaft can be interchangeably mounted to either side, that is, to the right or left side depending on the mounting of the prime mover; and that, because of the parallel relationship of the drive and input shafts, the drive for the propulsion assembly can be maintained regardless of its pivoted disposition which enables maintaining control of the vessel at all times. In the aforesaid system, control is provided aboard the vessel through mechanical linkage. It is the purpose of this invention to provide the aforesaid system with certain added improvements without forfeiting the advantages embodied therein by providing an integrated hydraulic control system in lieu of the mechanical control system wherein there is a hydraulic clutch for establishing the drive from the input shaft to the propeller, thus to avoid the need for an onboard clutch system, wherein there is a hydraulic motor for steering, thus avoiding the need for a steering system on board the vessel, wherein there is a hydraulic cylinder for maintaining the propulsion assembly in its operative position with its propeller submerged while permitting it to be displaced in the event of impact with an underwater structure and to restore it to its operative position after it has passed over an obstruction to thereby maintain control without damage to the propulsion assembly and to enable elevating the propulsion assembly when desired, wherein there is a hydraulic pump coupled directly to the input shaft so that hydraulic pressure is available for the hydraulic clutch, the hydraulic motor and the hydraulic cylinder whenever the input shaft is being driven by the prime mover for effecting operation of the aforesaid functions independently of each other.

SUMMARY OF INVENTION

As herein illustrated, the outboard motor assembly of the instant invention comprises a mounting platform for attachment to a vessel to which a prime mover can be bolted with its drive shaft in a horizontal position athwartship of the vessel, a propulsion assembly provided with an input shaft, trunion assemblies pivotally suspending the propulsion assembly from the platform outboard of the vessel for rotation about a horizontal axis coinciding with the axis of the input shaft and parallel to the drive shaft of the prime mover and a hydraulic system including a hydraulic pump coupled to the input shaft and a hydraulic cylinder coupled to the propulsion assembly, the latter being operable by pressure supplied thereto from the hydraulic pump to effect rotation of the propulsion assembly about said horizontal axis, said hydraulic system providing for locking the propulsion assembly in an operative position to provide normal driving thrust and with an override to permit displacement in the event of impact with underwater obstructions to minimize damage to the propulsion assembly. The hydraulic system also provides for restoring the propulsion assembly to its operative position after it has passed over an obstruction. The propulsion assembly comprises an upper gear box to which the trunion assemblies are interchangeably mounted and embody shaft bearings, the axis of which coincide with the axes of the trunions for receiving the input shaft from either side, a lower gear box, a propeller shaft journaled in the lower gear box, a propeller fixed to the propeller shaft, a transmission shaft for transmitting rotation of the input shaft to the propeller shaft, drive gears in the gear box, one of which is positioned about the input shaft and the other fixed to the transmission shaft, and a hydraulically-operable clutch operable by pressure generated by the hydraulic pump for drivably connecting the one gear to the input shaft. A steering column is positioned about the transmission shaft for rotation about the axis thereof, to the lower end of which is fixed the lower gear box, rotation of which provides for steering. Rotation of the steering column is provided for by a gear fixed thereto, a worm in mesh with the gear and a hydraulic motor coupled to the worm to which hydraulic pressure is supplied from said pump. A lubrication pump driven by the input shaft provides lubrication for the shaft bearings.

The invention will now be described in greater detail with reference to the accompanying drawings, wherein.

Figure 2:
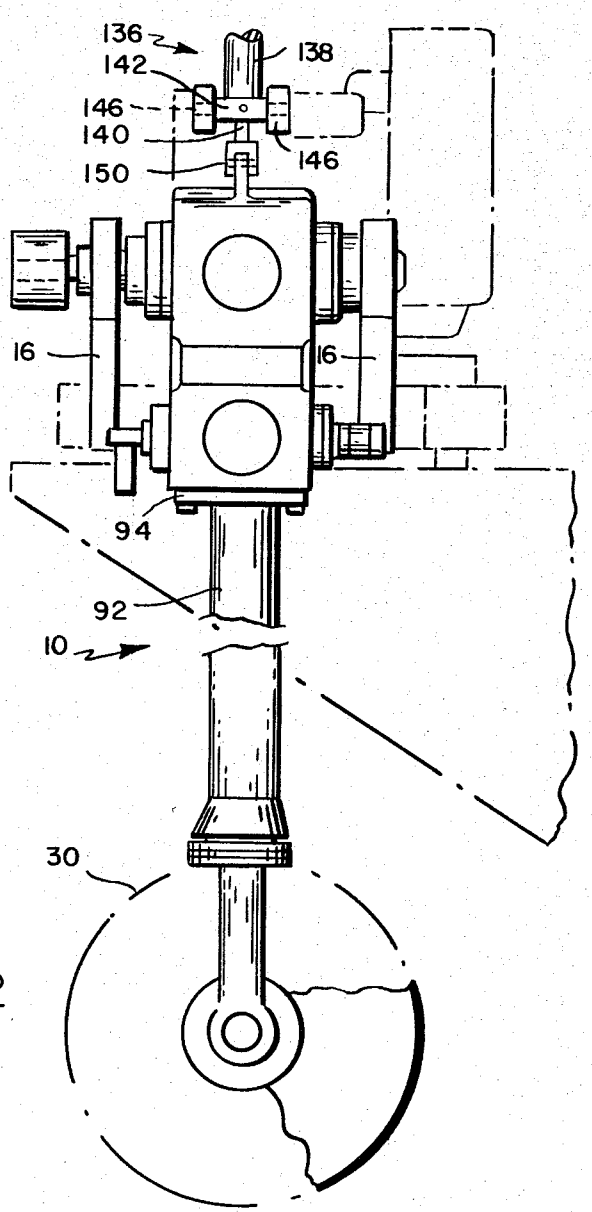
FIG. 2 is an elevation taken from the right side of FIG. 1.
Figure 1:
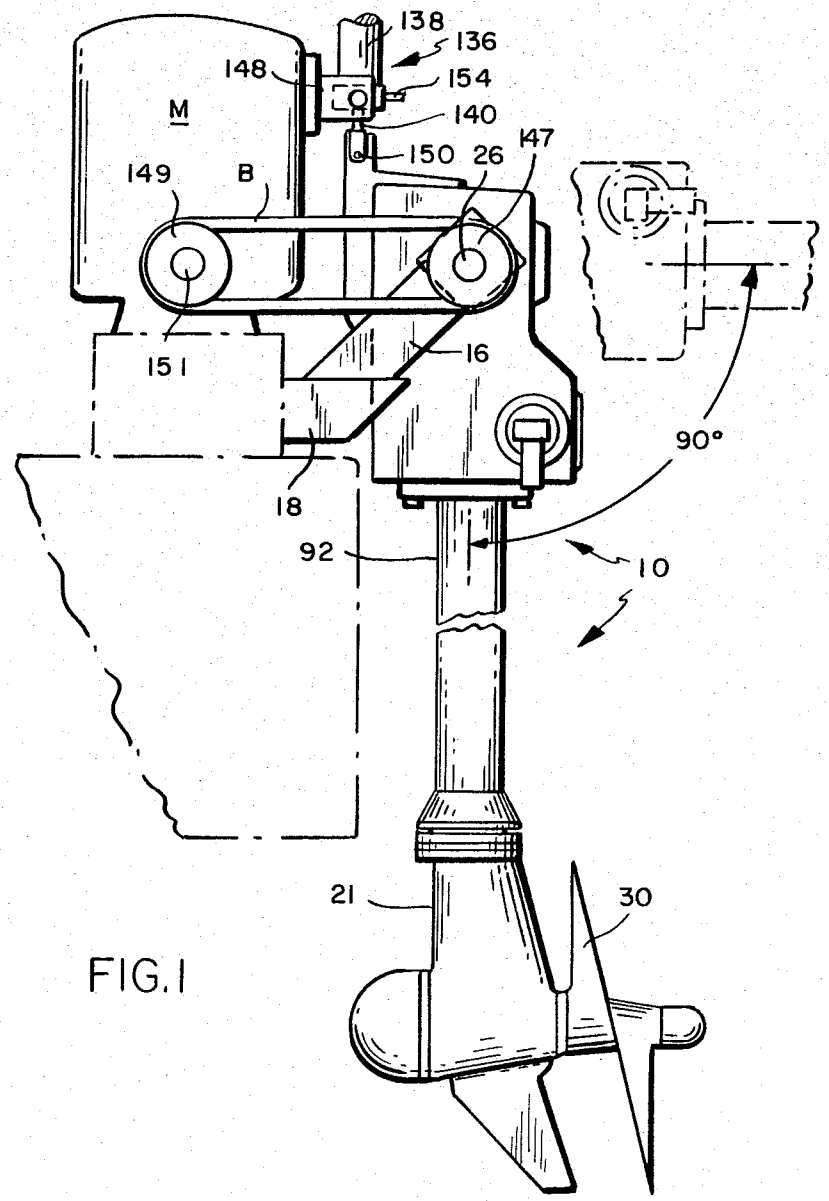
FIG. 1 is an elevation of the outboard motor assembly as seen from one side mounted to the stern of a vessel drivably connected to a power plant in the form of a combustion engine.
Figure 3:
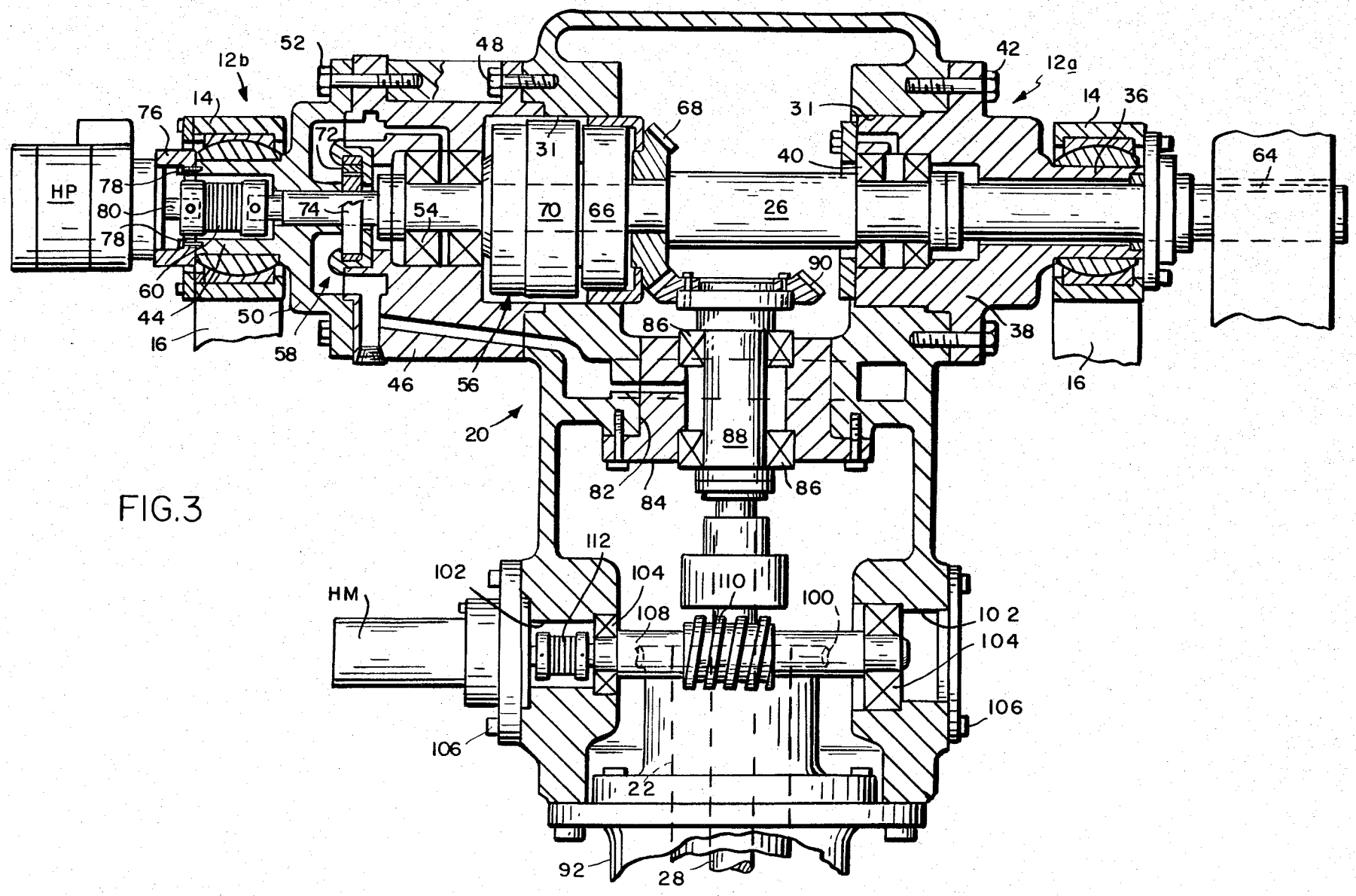
FIG. 3 is a transverse section of the upper part of the outboard propulsion assembly.
Figure 4:
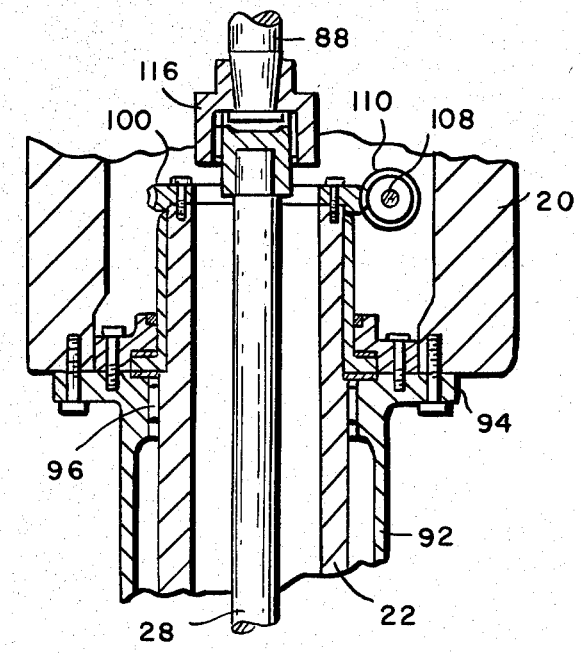
FIG. 4 is a transverse section of the lower part of the outboard propulsion assembly.
Figure 4:
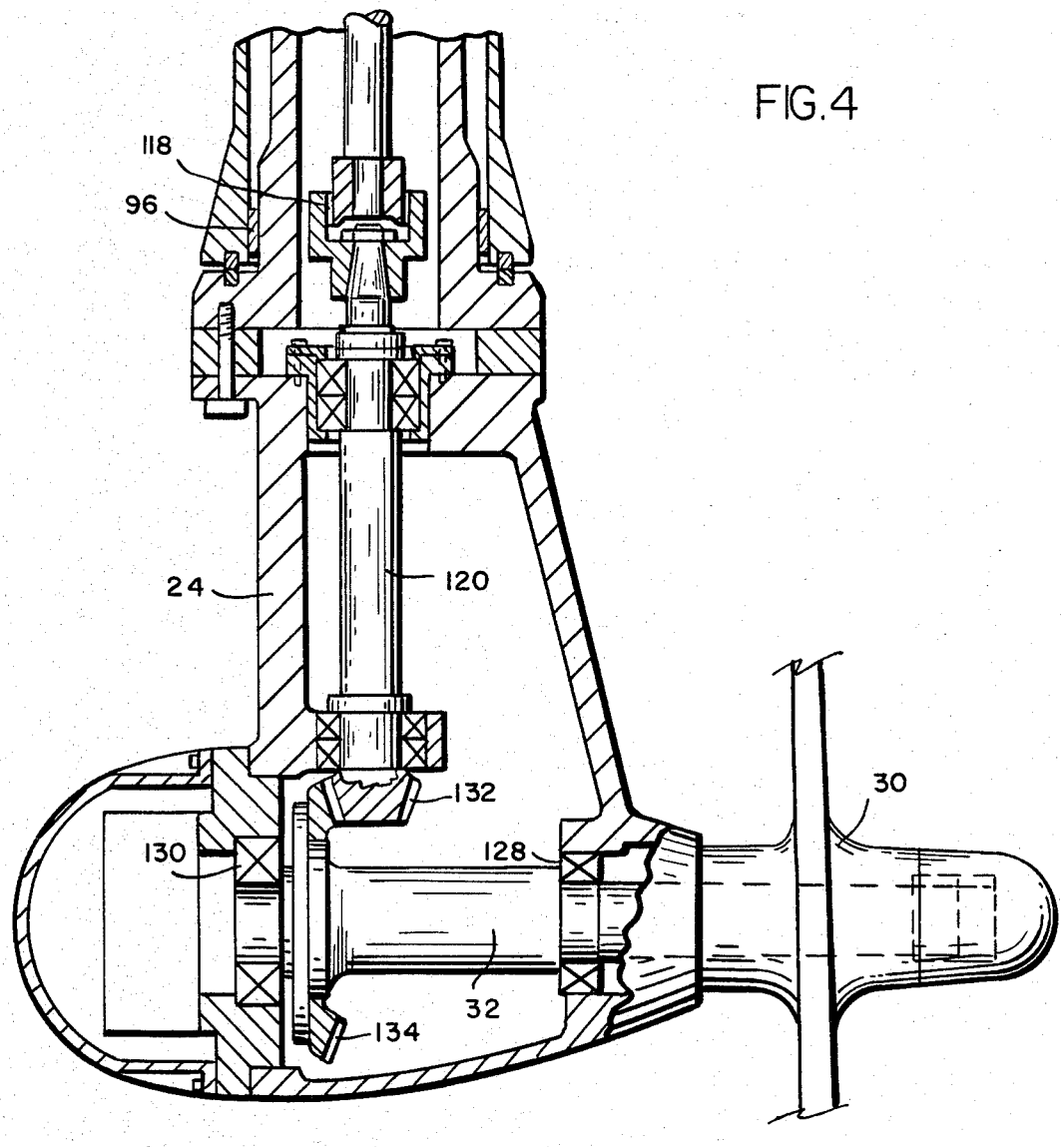
Figure 5:
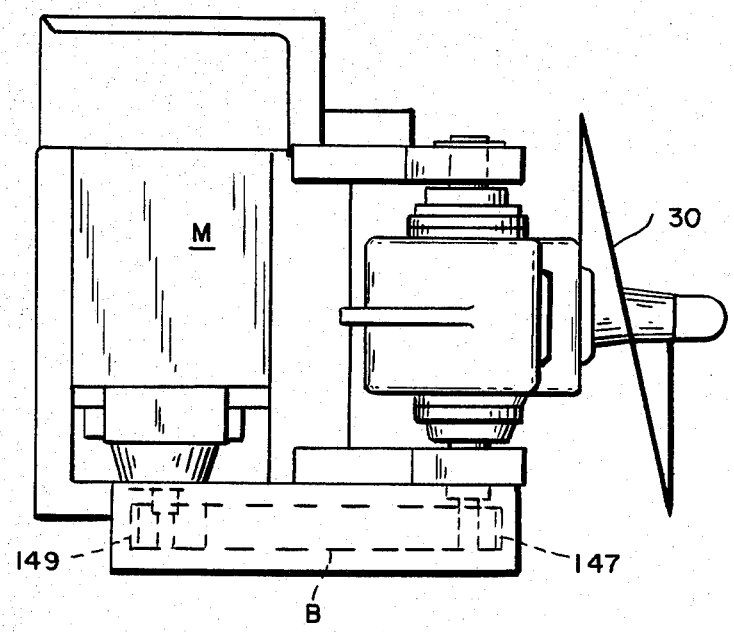
FIG. 5 is a plan view of the outboard motor assembly.

Referring to the drawings, FIGS. 1 and 2, the outboard propulsion assembly 10 is pivotally supported for angular movement in a vertical plane about a horizontal axis by trunion assemblies 12*a*,12*b*, FIG. 3, rotatably journaled in bearings 14—14 mounted to the upper ends of a pair of transversely-spaced arms 16—16, the lower ends of which are rigidly secured to a platform 18 which is adapted to be bolted to the structure of the vessel. The arms 16—16 rise from the platform at an angle of approximately 45° extending upwardly and rearwardly so as to suspend the assembly 10 freely aft of the vessel. A motor M is bolted to the platform and provides for transmitting power through a belt B to the input shaft of the assembly, as will appear hereinafter.

The outboard propulsion assembly comprises an upper gear box 20, a steering column 22, a lower gear box 24, an input shaft 26, a transmission shaft 28, a propeller 30 and propeller drive shaft 32.

Referring to FIG. 3, the upper gear box 20 comprises a casting provided with transversely-spaced, symmetrically-positioned openings 31—31 within which are interchangeably mounted the trunion assemblies 12*a*,12*b*. The trunion assembly 12*a* at the right side, FIG. 3, comprises a trunion 36 and a bearing housing 38 within which there is mounted in concentric relation with the axis of the trunion 36 a shaft bearing 40. The trunion assembly 12*a* is secured to the gear box by bolts 42. The trunion assembly 12*b* at the left side, FIG. 3, comprises a trunion 44 and a two-part hpusing comprising a part 46 bolted to the gear box by means of bolts 48 and a part 50 bolted to the part 46 by bolts 52. The part 46 provides a housing for a shaft bearing 54 and a hydraulic clutch assembly 56. The parts 46 and 50 provide, in conjunction, a housing for a pump assembly 58 and the part 50 provides a housing for a coupling element 60. The input shaft 26 is positioned within the gear box and rotatably supported therein by the bearings 40 and 54 in concentric relation to the axis of the trunions 36 and 44 with the end at the right side, as shown in FIG. 3, protruding from its trunion at that side provided with a keyway 64 and the opposite end terminating within the trunion at that side connected to the spring coupling 60. The clutch assembly 56 comprises a driven part 66 to which there is bolted a gear 68 and a driving part 70 splined to the shaft 26 and movable therealong to become engaged or disengaged with the driven part 66. The driving part 70 is engaged and disengaged with the driven part 66 by hydraulic pressure. The lubrication pump assembly 58 comprises a stator 72 secured to the part 46 and a rotor 74 keyed to the input shaft 26.

A hydraulic pump HP is mounted to the outer end of the trunion 44 by a coupling member 76 secured by bolts 78, with its pump shaft 80 aligned with the axis of the input shaft 26 and connected thereto by the spring coupling 60 so that rotation of the input shaft 26 rotates the hydraulic pump and thus provides hydraulic pressure for actuating the clutch assembly 56 and the lubricating pump 58.

The gear box 20 contains an opening 82 positioned midway between the openings 31—31, the axis of which is at right angles to the axis of the openings 31—31 within which there is secured a bearing support 84 which provides support for bearings 86—86 within which is journaled a shaft 88, to the upper end of which is fixed a gear 90 in mesh with the gear 68. Rotation of the input shaft 26 when the clutch assembly is engaged will thus drive the shaft 88.

The lower part of the gear housing 20 contains an opening concentric with the opening 82. The steering column assembly 22 comprises a housing 92 provided with a flange 94 at its upper end by means of which it is bolted to the lower end of the gear box within which there is rotatably mounted axially-spaced bearings 96—96 for the steering column 22. The upper end of the steering column 22 projects into the lower end of the gear box and has secured to it a ring gear 100. The gear box has transversely-spaced, aligned openings 102—102 for receiving bearing assemblies 104—104 which are secured therein by bolts 106. A shaft 108 is journaled in the bearings 104—104 on which there is a worm 110 which meshes with the gear 100. Rotation of the shaft 108 will, therefore, effect rotation of the worm, rotation of the gear and, hence, rotation of the steering column 22. Rotation of the shaft 108 is achieved by means of a hydraulic motor HM connected by a spring coupling 112 to the shaft 108.

The transmission shaft 28 is connected by an upper coupling assembly 116 to the lower end of the shaft 88 and at its lower end by a coupling assembly 118 to a shaft 120 journaled within the lower gear box 24, the latter being bolted to the lower end of the steering column 22. The propeller 30 is mounted to the lower gear box on the shaft 32 which is journaled in bearings 128 and 130 with its axis at right angles to the axis of the shaft 120 and drivably connected thereto by meshing gears 132 and 134 fixed, respectively, to the shaft 120 and the shaft 32.

As thus constructed, the propulsion assembly is rotatable about a horizontal axis coinciding with the axis of the trunions and such rotation will move the propulsion assembly angularly about the axis of the input shaft in a vertical plane athwartship of the vessel. In order to achieve such arcuate movement when desired, for example, to move the propeller from a position submerged to an elevated position for the purpose of repair, there is provided an elevating assembly 136 comprising a hydraulic cylinder 138 from one end of which projects a piston rod 140. The hydraulic cylinder is fixed to a block 142 rotatably journaled by trunions 146—146 on a bracket member 148 bolted to the motor housing. The projecting end of the piston rod is pivotally connected by a pin 150 to a bracket fixed to the top of the gear box. Hydraulic pressure is supplied to the hydraulic cylinder 138 through a conductor 154 connected to the hydraulic pump HP. By controlling the flow of hydraulic pressure to the hydraulic cylinder 138, the position of the propulsion assembly can be controlled at will.

The hydraulic motor for steering, the pump for effecting lubrication of the shaft housing, the elevating cylinder for raising and lowering the propulsion assembly and the hydraulic clutch for establishing a driving connection between the input shaft and the transmission shaft of the propeller are all integrated in the propulsion assembly independently of the vessel on which it is mounted so that no tailoring is required.

Figure 6:
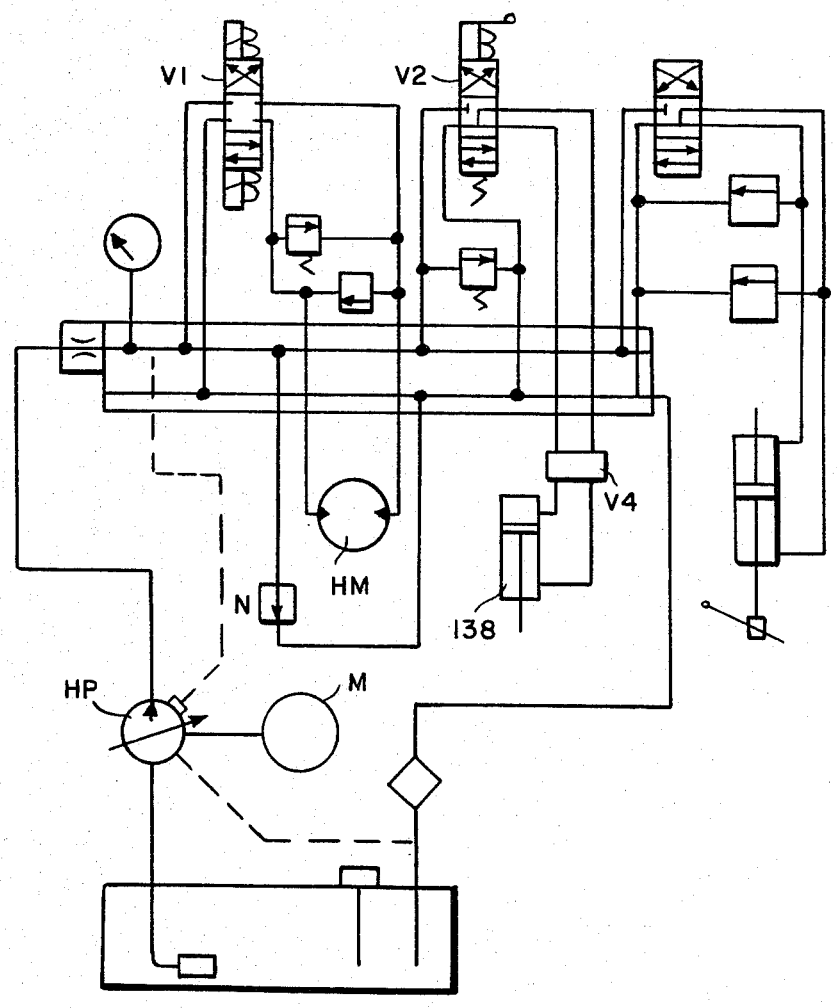
FIG. 6 is a diagrammatic of the hydraulic system.

The hydraulic system provided for achieving the foregoing is illustrated in FIG. 6. As therein shown, the prime mover M drives the hydraulic pump HP by way of the input shaft 26 which, in turn, supplies pressure to the hydraulic cylinder 138, to the hydraulic motor HM and to the hydraulic clutch 56. The system includes a directional valve V1 for controlling the supply of fluid to the hydraulic motor HM for steering, a directional valve V2 for controlling flow of hydraulic fluid to the hydraulic elevating cylinder 138 and a directional valve V3 for supplying hydraulic pressure to a hydraulic cylinder 139 which effects operation of the hydraulic clutch 56. In accordance with the invention, the system incorporates in conjunction with the hydraulic cylinder 138 a relief valve V4 set to release at approximately 200 pounds per square inch in excess of the thrust rating of the propulsion assembly to permit the propulsion assembly to ride over underwater obstructions and to be restored to its operative position following displacement.

For driving the input shaft 26, a drive pulley 147 is keyed to the input shaft 26 and the belt B is entrained at one end about the pulley 147 and at its other end about a pulley 149 keyed to the drive shaft 151 of the motor M.

The outboard assembly thus described embodies all of the essential operating functions so that when supplied to a customer, substantially all that is necessary for installation is to mount it to the vessel by engaging the trunions with the bearings at the end of the arms 16 and connect input shaft 26 to the drive shaft 151 of the motor which is to drive the same by means of the belt B.

The hdyraulic pressure generated by the hydraulic motor provides sufficient hydraulic pressure in the cylinder 138 to hold the outboard propulsion assembly in the required position for propulsion without separate supporting structure such as frames which project below the deck surface or thrust bearings which must be welded or supported by the hull of the vessel as required by known installations. Eliminating the need for such frames or struts allows the assembly to be removed without the need to disconnect hold-down means or thrust bearing assemblies located below the deck level.

Since the position of the propulsion unit is achieved by hydraulic rather than mechanical locking means, elevation can be accomplished simply by manipulation of the appropriate valve of the hydraulic system to attain the desired position. This can be accomplished while retaining the capability of producing thrust at any point in the elevating arc limited only by adequate propeller submergence. The self-supporting structure of the propulsion assembly coupled with the hydraulic locking override feature allows the propulsion assembly to ride up and over submerged objects to reduce or prevent damage. Since thrust and control are not lost in such an occurrence except in the case of severe damage, the vessel can continue underway. This eliminates the possible hazards presented by need to shut down and go over the side to replace the sheared or fractured stem support bolts to reestablish thrust and control. Eliminating the need for separate propulsion supports also allows the unit to be transported readily by disconnecting the deck hold-down bolts and elevating the entire assembly for transportation by truck, rail car or any other carrier without disassembling of any of its components. As disclosed above, the simplified drive system is achieved by the use of the upper gear box which locates the center lines of the trunions and supporting bearings, the hydraulic clutch, the lubricating oil pump and the hydraulic pump on a common axis. This allows the use of a coaxially-mounted disconnecting clutch and lubricating pump within the gear box and an externally-mounted, direct-driven hydraulic pump. The location of all of the required accessory drives on the outboard propulsion unit system thus eliminates all interface problems associated with mounting accessories on the prime mover. Power is transmitted to the hydraulic motor for steering and the hydraulic cylinder for elevation by the hydraulic pump. A common axis of the output propulsion assembly trunions, shaft bearings and power input shaft allows the propulsion assembly to rotate about the input shaft to achieve elevation and pickup capability. The incorporation of the steering system in the propulsion assembly eliminates the need for any piping or control connections between the propulsion assembly and the prime mover and coaxial mounting of the hydraulic pump and lubricating oil pump eliminates all requirements for indirect drive. Prelubrication of the drive train is achieved prior to clutch engagement immediately upon start of the prime mover.

It should be understood that the present disclosure is for the purpose of illustration only and includes all modificatins or improvements which fall within the scope of the appended claims.

What is claimed is:

1. An outboard motor system comprising a mounting platform for attachment to the deck of a vessel, transversely-spaced bearings fixed to the mounting platform and extending rearwardly outboard of the stern from the mounting platform, a propulsion assembly comprising a housing provided with transversely-spaced trunions rotatably journaled in said bearins supporting the propulsion assembly from the platform outboard of the vessel for rotation in a vertical plane about the axis of the trunions, an input shaft rotatably journaled in the housing with its axis coinciding with the axis of the trunions and with its ends extending outward thereof, a sheave fixed to one end of the input shaft outboard of the trunion at that end, a hydraulic pump coupled to the other end of the input shaft outboard of the trunion at that end, said propulsion assembly comprising, in addition, a propeller, kinematic means for connecting the input shaft to the propeller such that rotation of the input shaft will effect rotation of the propeller and a clutch means operable by the hydraulic pump to drivably connect the input shaft to the kinematic means, hydraulically-operable means comprising a piston and cylinder assembly provided with a reciprocal piston rod mounted to the platform with the distal end of the piston rod pivotally connected to the housing of the propulsion assembly at a radial distance from the axis of the trunions, means for controlling the direction of flow of hydraulic fluid to the hydraulically-operable means operable to hold the housing of the propulsion assembly in an operative position such as to effect propulsion of the vessel and override means operable to permit displacement of the housing of the propulsion assembly and, hence, the propeller in a vertical plane in an arc about the axis of the trunions and input shaft in the event of impact with a submerged object.

2. An outboard motor system according to claim 1 wherein said override means restores the propulsion assembly to its operative position following override.

3. An outboard motor system according to claim 1 wherein the control means enables elevating the propulsion assembly to a position withdrawn from the water.

4. An outboard motor system according to claim 1 wherein there is a prime mover bolted to the platform with its drive shaft parallel to the input shaft of the propulsion assembly, sheaves fixed to the respective shafts and a belt entrained about said sheaves which enables arcuate movement of the propulsion assembly without loss of the driving connection between the drive shaft and the input shaft and, hence, without loss of control.

5. An outboard motor assembly according to claim 1 wherein the propulsion assembly includes a gear box mounting the propeller, a rotatably mounted steering barrel positioned about the transmission shaft, to the lower end of which the gear box is fixed, a drive gear at the upper end of the steering barrel, a drive worm rotatably journaled in the housing in mesh with the drive gear and a hydraulic motor mounted to the housing for driving the worm to enable rotation of the steering barrel and means for supplying hydraulic pressure from the hydraulic pump to the hydraulic motor.

6. An outboard motor system according to claim 5 wherein the lower part of the housing is structured to interchangeably receive the worm and hydraulic motor from either side of the housing.

7. An outboard motor assembly according to claim 1 wherein said trunions are interchangeably attached to the housing and embody shaft bearings, the axis of which coincides with the axis of the trunions for rotatably receiving the input shaft from either side.

8. An outboard motor system according to claim 7 wherein the kinematic means comprises a transmission shaft for transmitting rotation from the input shaft to the propeller, meshing drive gears in the housing, one of which is positioned about the input shaft and the other of which is fixed to the transmission shaft and means for controlling the direction of flow of hydraulic fluid to said hydraulic clutch means.

9. An outboard motor system according to claim 8 wherein the hydraulic clutch means comprises a first part fixed to the gear positioned about the input shaft and a second part splined on the input shaft for movement therealong into and out of engagement with said first part.

10. An outboard motor system according to claim 8 wherein one of the trunion assemblies embodies one of the shaft bearings and the other the other shaft bearing and the hydraulic clutch means.

11. An outboard motor system according to claim 8 wherein one of the trunion assemblies embodies one of the shaft bearings and the other the other shaft bearings, the hydraulic clutch means and a lubrication pump and wherein the lubrication pump is driven by rotation of the input shaft.

12. An outboard motor system according to claim 8 wherein one of the trunion assemblies embodies one of the shaft bearings and the other the other shaft bearing and the hydraulic clutch means and wherein the hydraulic pump is mounted to the latter trunion assembly with its drive shaft coupled to the input shaft.

13. An outboard motor system according to claim 12 wherein a spring coupling couples the hydraulic pump to the input shaft.

14. An outboard motor system comprising a propulsion assembly including a propeller and input shaft adapted to be pivotally suspended athwartship of a vessel for arcuate movement about a horizontal axis coinciding with its input shaft, a hydraulic cylinder for effecting elevation and depression of the propulsion assembly about said horizontal axis, a hydraulic clutch for establishing a driving connection between the input shaft and the propeller, a hydraulic motor for effecting steering, said hydraulic clutch, hydraulic cylinder and hydraulic motor comprising integrated component parts and the propulsion assembly, and a hydraulic pump mounted to the propulsion assembly and coupled to the input shaft for supplying hydraulic pressure to said cylinder, clutch and motor.

* * * * *